United States Patent [19]

Mladota

[11] Patent Number: 4,765,272

[45] Date of Patent: Aug. 23, 1988

[54] COATING DEVICE FOR MATERIAL WEBS

[75] Inventor: John Mladota, Lausanne, Switzerland

[73] Assignee: Bolton-Emerson, Inc., Lawrence, Mass.

[21] Appl. No.: 688,016

[22] Filed: Dec. 31, 1984

[30] Foreign Application Priority Data

Feb. 20, 1984 [DE] Fed. Rep. of Germany ..... 3406099

[51] Int. Cl.[4] ..... B05C 5/02

[52] U.S. Cl. ..... 118/410; 118/414

[58] Field of Search ..... 118/410, 411, 414

[56] References Cited

U.S. PATENT DOCUMENTS

| | | | |
|---|---|---|---|
| 1,929,877 | 10/1933 | Bonamico | 118/410 |
| 2,474,254 | 6/1949 | Kauffman | 118/410 |
| 2,988,120 | 6/1961 | Forrest | 118/410 X |
| 3,479,989 | 11/1969 | Hunter et al. | 118/410 X |
| 3,642,181 | 2/1972 | Thomas et al. | 118/410 X |
| 3,906,757 | 9/1975 | Arimoto et al. | 68/20 |
| 4,333,420 | 6/1982 | Petri | 118/411 |
| 4,412,506 | 11/1983 | Morita | 118/683 |
| 4,465,015 | 8/1984 | Osta et al. | 118/414 X |
| 4,534,309 | 8/1985 | Damrau et al. | 118/410 |
| 4,550,681 | 11/1985 | Zimmer et al. | 118/410 |

FOREIGN PATENT DOCUMENTS

| | | |
|---|---|---|
| 0091147 | 10/1983 | European Pat. Off. . |
| 1945138 | 5/1966 | Fed. Rep. of Germany . |
| 3100101 | 7/1982 | Fed. Rep. of Germany . |
| 67307 | 11/1984 | Finland . |

*Primary Examiner*—John P. McIntosh

*Attorney, Agent, or Firm*—Wolf, Greenfield & Sacks

[57] ABSTRACT

A device for the application of a thin layer of a coating material (7) onto a material web (2) passing across a backing roller (1) comprises a slot nozzle arrangement (3) having a nozzle slot (4). In order to ensure uniform and sufficient delivery of coating material (7) across the length of the nozzle slot (4), the coating material (7) is delivered from a supply container (8) through a delivery channel (10, 11) extending across the coating width to the nozzle slot (4) of the slot nozzle arrangement (3) and in the delivery channel (10, 11) of the slot nozzle arrangement (3) a gear pump arrangement (12) is provided which has a plurality of rectilinearly aligned pump sections (13), each having two intermeshed pump gears (14, 15), the arrangement extending over the coating width and arranged with the distance pieces mounting the pump gears (14, 15) between the pump sections (13) to be easily removable. The distance pieces (16) are formed as carbon bearings and the parts are channeled for heating and cooling.

10 Claims, 2 Drawing Sheets

COATING DEVICE FOR MATERIAL WEBS

BACKGROUND OF THE INVENTION

I am aware that gear pumps, separate from the extrusion die of an extrusion apparatus, have been heretofore used to supply coating to a coating nozzle.

It has also been proposed, as in U.S. Pat. No. 3,162,886 to Wise of Dec. 29, 1964, to provide a pair of outlet nozzles leading from a hopper containing mortar, each nozzle having an elongated helical feed auger therewithin for delivering mortar to each opposite side of cement block structures.

In U.S. Pat. No. 3,333,567 to Rich, et al, of Aug. 1, 1967 a butter extruder is disclosed in which a thin sheet of butter is extruded from a nozzle with the assistance of a single, elongated gear pump, full length of the nozzle and a manifold housing full of packed butter under pressure.

However, as far as I am aware the prior art has not disclosed an elongated, narrow, extrusion slot nozzle for extruding a thin, layer of uniform thickness onto a moving web of material, the nozzle having a built-in gear pump formed in a rectilinearly, axially, aligned, set of separate intermeshed pairs of gears, spaced apart preferably by carbon bearings, all parts removable for cleaning and channeled for heating or cooling.

SUMMARY OF THE INVENTION

The invention relates to a device for applying a thin coating of coating material onto a material web passing across a backing roller and comprising a slot nozzle arrangement having a nozzle slot. Such a device is known for example from DE-PS No. 31 00 101, or U.S. Pat. No. 3,556,832 of Jan. 19, 1971 to George Park.

In such coating devices the main point is that the coating material is applied across large breadths of many meters and evenly across the breadth and accordingly even and sufficient delivery of coating material must be ensured along the nozzle slot.

The invention is based on the object of creating a coating device of the above described type with which sufficient and satisfactory delivery of coating material to the nozzle slot is ensured which is uniform over the entire desired coating device width. In addition, both simple adaption of the coating device to differing coating widths and also rapid and simple cleaning of the slot nozzle arrangement when converting to different coating materials should be ensured.

This object is achieved according to the invention in that the coating material is delivered from a supply container to the nozzle slot of the slot nozzle arrangement through a delivery channel passing across the coating width, and in that in the delivery channel of the slot nozzle arrangement a gear pump arrangement which has a plurality of pump sections each having two intermeshed pump gears, extends across the coating width, and is arranged between the pump sections to be easily removable with distance pieces or spacers mounting the pump gears.

Such an arrangement allows a sufficient amount of coating material divided uniformly across the coating breadth to be available at the nozzle slot, the number of pump sections being selected according to the desired coating width and being modifiable in an easy manner.

Advantageously, the pump gears are mounted in the distance pieces by means of axle ends on both sides and the driven pump gears are connected together for driving via axle connecting pieces engaging in the pump gears in a form locking manner in the region of the distance pieces. The drive of the driven pump gears can thus be achieved by means of a single drive motor.

The distance pieces are expediently constructed as carbon bearings.

Advantageously, the slot nozzle arrangement is pivotably constructed with respect to a plane passing through the central longitudinal plane between the pump gears. With this construction both the number of pump sections can be adapted to the required coating width in a simple and expedient manner and a quick and thorough cleaning of the slot nozzle arrangement can take place upon changing of the coating material. Finally, it is particularly significant when as a result of operation with a small charge the device must be converted relatively rapidly.

The axial length of the pump gears is expediently approximately twice the axial length of the distance pieces. By this means, completely uniform distribution of the coating material along the nozzle slot is achieved.

In current and usual coating processes, the pump gears are advantageously driven at approximately 10 to 12 rpm.

Furthermore, with the slot nozzle arrangement according to the invention it can be advantageous to provide in the region of the delivery channel and of the gear pump arrangement heating or cooling channels extending across the coating width which ensure good heat transfer within the slot nozzle arrangement.

The walls of the supply container are expediently heated, particularly for the processing of hot melt coatings.

Furthermore, it is advantageous to arrange between the gear pump arrangement and the nozzle lips of the slot nozzle arrangement a rod-like circular gate valve for closing the delivery channel, the closure rod of the circular gate valve being mounted expediently beneath the delivery channel in the vicinity of the nozzle lips. By this means there results not only an extremely improved convenience of conversion and cleaning of the slot nozzle arrangement, but also the possibility of improved error-free coating of the material web.

The invention is explained in more detail in the following with reference to an exemplary embodiment illustrated in the drawings.

DESCRIPTION OF THE PREFERRED EMBODIMENT

Figure 1:
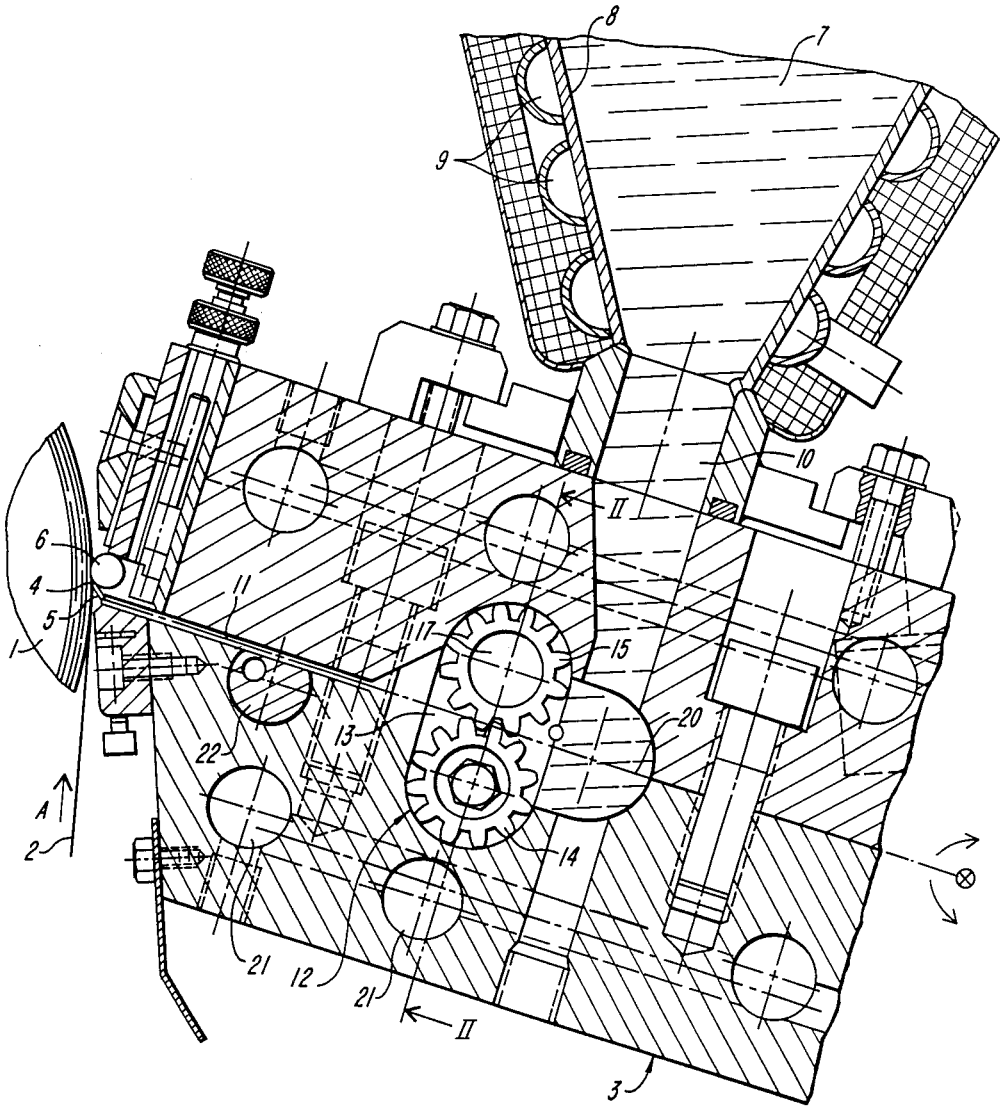
FIG. 1 shows a lateral sectional view of the nozzle slot arrangement and coating device according to the invention.
Figure 2:
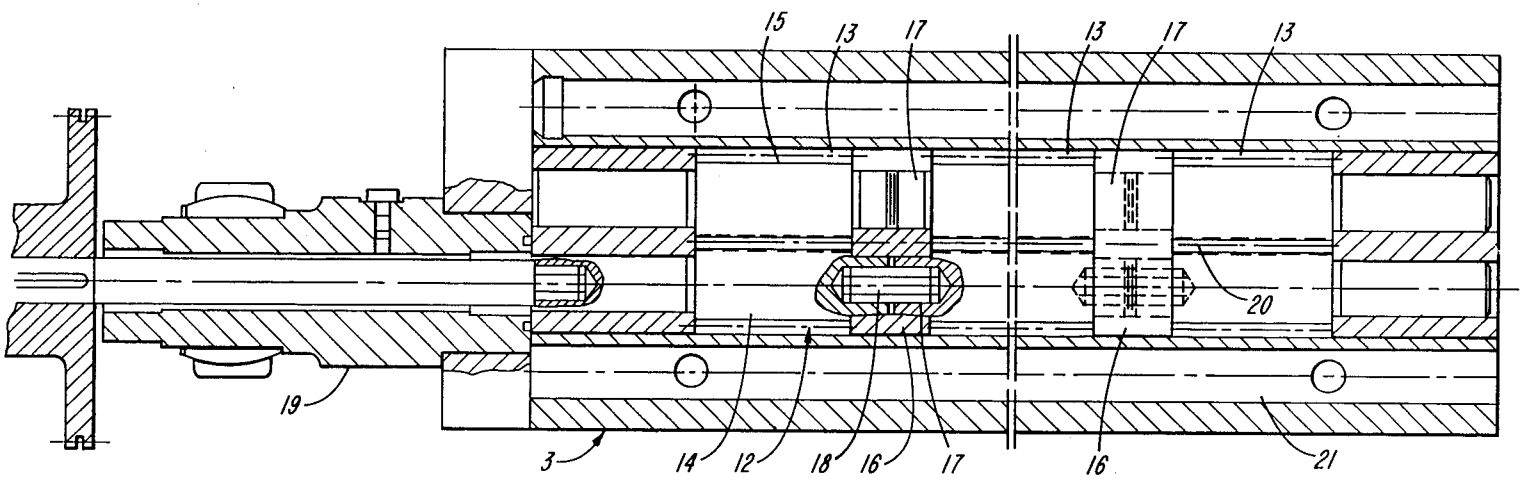
FIG. 2 shows a longitudinal sectional view along the line II—II through the pump arrangement of the slot nozzle arrangement in FIG. 1.

FIGS. 1 and 2 illustrate a preferred embodiment of a device according to the invention for the application of a thin coating of a coating material and has a backing roller 1, which has a surface layer of normal or hard rubber. A material web 2 to be coated is guided across the backing roller 1 in the direction of the arrow A.

On one side of the backing roller 1, is provided a slot nozzle arrangement 3 having a fixed lead-on nozzle lip and a lead-off nozzle lip of the nozzle slot 4. The lead-on nozzle lip 5 of the nozzle slot 4, is fixed, and the lead-off nozzle lip 6 of the nozzle slot 4 is constructed as a rotatable doctor member 6.

Material webs to be coated are for example, paper webs, synthetic foils, metal foils, fabric webs and combinations of such material webs. Thus, the material web can be an aluminum foil of 0.008 mm, 0.012 mm, 0.02 mm and up to 0.12 mm thickness. A paper web may be flat, rubbed or creped papers of 40 to 120 g/m$^2$, synthetic foils may be polyethylene foils of 40 to 120 μm thickness, biaxial spun so-called oriented polypropylene foil of 30 to 120 μm thickness and polyester foils in the same thickness range. Furthermore, hard PVC foils and monomer or polymer plasticized PVC foils can be processed and fabric webs may include for example carpet laying strips and binding materials.

Coating materials may for example, include paraffins and microcrystalline waxes having processing temperatures between 75° C., and 100° C. with application amounts between 4 and 40 g/m$^2$. Furthermore, coating hot melts consisting of ethylevinylacetate copolymers, mixed with paraffin and resins may be employed at processing temperatures between 140° C. and 190° C. for the upper surface treatment of backing materials. Melted adhesives used have processing temperatures between 140° C. and 190° C. when using amounts between 12 and 40 g/m$^2$, whilst thermoset adhesives are processed at temperatures of 70° C. to 80° C. and application amounts from 40 g/m$^2$. Polyurethane adhesives consisting of two components are mixed shortly before coating.

Further coating materials are aqueous emulsions and dispersions to form a PVDC coating at room temperature. Acrylate adhesives as aqueous dispersions with coating likewise at room temperature, various strong adhesives which are processed at temperatures of 70° C. to 90° C., binding materials and coating masses which are dissolved in organic solvents and are processed at room temperature and finally cold setting PVC adhesive on the basis of polyvinyl alcohol may be employed.

Coating material 7 is located in a supply container, or hopper 8, which can be heated by heating tubes 9. By way of a delivery channel 10 passing over the largest coating width, the coating material 7 is delivered by gravity feed to a gear pump arrangement 12, also extending across the coating width and from there is pumped by the gear pump arrangement 12, through a further delivery channel 11 of the nozzle slot 4, which extends across the largest coating width.

The gear pump arrangement 12, has a plurality of rectilinearly aligned, spaced apart, pump sections 13, each having a driven pump gear 14 and a co-running intermeshed pump gear 15. Between the pump sections 13 are arranged distance pieces, or spacers 16, which mount the pump gears 13, 14. Both the pump sections 13 and also the distance pieces 16, are arranged in the slot nozzle arrangement 3, to be easily removable for conversion and cleaning of the slot nozzle arrangement. Adaption to various coating widths can be achieved by insertion of a corresponding number of pump sections 13 and distance pieces 16, in the slot nozzle arrangement.

The pump gears 14, and 15 are mounted in the distance pieces 16 by means of axle ends 17 on both sides. Furthermore, the driven pump gears 14 are connected together in driving connection in the vicinity of the distance pieces 16 by means of axial connecting pieces 18 which engage in the pump gears 14 in a form locking manner, drive of all pump sections 13 being thus possible in common from the side 19 of the gear pump arrangement 12, at a speed of approximately 10 to 20 rpm. The distance pieces 16 are preferably constructed as carbon bearings.

The slot nozzle arrangement 3, is pivotally constructed in respect of a plane extending through the central longitudinal plane 20, between the pump gears 14, and 15, whereby conversion and cleaning of the slot nozzle arrangement 3, can be carried out in a particularly simple and convenient manner. The nozzle pivots open about a pivot point shown at the right side of FIG. 1.

The axial length of the pump gears 14, and 15 amounts advantageously to approximately twice the axial length of the distance pieces 16, whereby in each case a uniform distribution of the coating material 7 is ensured along the length of the nozzle slot 4.

In the region of the delivery channel 10, 11 and the gear pump arrangement 12 expediently heating or cooling channels 21 can be provided extending across the coating width in order to ensure good heat transfer.

Between the gear pump arrangement 12, and the nozzle lips 5 and 6, is arranged beneath the delivery channel 11 in the vicinity of the nozzle lips 5 and 6, a closure rod 22, of a rod-like circular gate valve for closing the delivery channel 11. This circular gate valve is not only advantageous in respect of conversion and cleaning of the slot nozzle arrangement 3, but also ensures that with the described slot nozzle arrangement problem-free coating can be achieved.

I claim:

1. A slot nozzle arrangement for applying a thin coating of a coating material onto a web, comprising:

a housing;

a supply passageway in the housing;

a plurality of pairs of meshed gears in the housing, the supply passageway leading through the housing to the engagement of the pairs of meshed gears, at least one of each pair being driven and in turn, driving the other of the pair to provide pump gears, the said driven gears being aligned coaxially;

an axle between and connected coaxially to each said adjacent driven gears in a form locking manner;

a spacer in the housing between each adjacent two said driven gears, each of said spacers serving also as a bearing to mount an axle;

a delivery passageway in the housing;

a slot nozzle extending the width of the coating to be applied and to which nozzle the delivery passageway leads from the gear intersections;

the housing being separable along a central plane on which the central surfaces of the passageways and the line of engagement of the gears lie;

and said housing being pivotally connected to open along said central plane to service and clean; the spacers individually, the axles individually, the gearings individually, the passageways and the nozzle.

2. A slot nozzle arrangement as claimed in claim 1, the end driven gear at one side of the axially aligned driven gears is arranged to receive drive, thereby to drive all the axially aligned driven gears through the axles.

3. A slot nozzle arrangement as claimed in claim 1, said spacers being of carbon to serve as carbon bearings.

4. A slot nozzle arrangement as claimed in claim 1, the axial extension of the pump gears being twice the axial length of the spacers.

5. A slot nozzle arrangement as claimed in claim 1, the pump gears being designed to be driven at a speed between about ten and about twelve r.p.m.

6. A slot nozzle arrangement as claimed in claim 1, the housing having a channel therethrough near to and extending the width of the nozzle for one of heating and cooling fluids.

7. A slot nozzle arrangement as claimed in claim 1, further comprising a supply container having an outlet leading to the supply passageway in the housing, said container having walls with heating means.

8. A slot arrangement as claimed in claim 1, further comprising a rotatable gate valve interposed in and along the width of the delivery passageway in the housing for selectively closing and opening the said delivery passageway.

9. A device for applying a thin coating of a coating material onto a web moving over a backing roller comprising:

an extrusion die with an elongated narrow nozzle extending the full width of the web;

a delivery channel for delivering coating material to the die;

a container for the material having an outlet;

a plurality of axially aligned, separate, spaced apart gear pumps in the delivery channel for the die interposed between the container and the die, each pump comprising a pair of intermeshed gears, at least one of each pair being a driven gear, and the driven gears being axially aligned and drivingly connected, each driven gear driving the other gear of the pair;

a plurality of elongated bearings, each pump being spaced apart from the adjacent pump by said bearings;

the die being formed of housing members that are pivotally connected to separate about a central longitudinal plane, including the line of engagement of the gears, thereby to open for cleaning of the die.

10. A device as claimed in claim 9, said die having fluid channels in the region of the delivery channel, the gear pumps, and the supply container for one of heating and cooling the coating material.

* * * * *